United States Patent [19]

Hutchison et al.

[11] 4,099,563

[45] Jul. 11, 1978

[54] STEAM INJECTION SYSTEM FOR USE IN A WELL

[75] Inventors: Stanley O. Hutchison, Bakersfield; Glenn W. Anderson, Oildale, both of Calif.

[73] Assignee: Chevron Research Company, San Francisco, Calif.

[21] Appl. No.: 783,131

[22] Filed: Mar. 31, 1977

[51] Int. Cl.[2] ..... E21B 33/122; E21B 43/12

[52] U.S. Cl. ..... 166/191; 166/202; 166/317; 166/318; 137/71; 137/874

[58] Field of Search ..... 166/191, 186, 147, 202, 166/317, 318, 325, 306, 303, 269, 127, 194; 137/71, 625.48, 595, 610

[56] References Cited

U.S. PATENT DOCUMENTS

| | | | |
|---|---|---|---|
| 2,611,436 | 9/1952 | Carr et al. | 166/269 |
| 2,662,600 | 12/1953 | Baker et al. | 166/154 |
| 3,349,849 | 10/1967 | Closmann | 166/303 |
| 3,530,939 | 9/1970 | Turner | 166/303 |

*Primary Examiner*—James A. Leppink

*Attorney, Agent, or Firm*—R. L. Freeland, Jr.; Edward J. Keeling

[57] ABSTRACT

A steam injection system including a steam deflector connectable into a tubing string which steam deflector provides for selectively passing steam through the tubing string to the bottom thereof or diverting steam from inside the tubing string out into the wall liner-tubing annulus and in a direction concentric with and substantially parallel to the longitudinal axis of the tubing string and above the bottom end thereof utilizing a sliding-sleeve arrangement and packer cup means packing off the well liner-tubing annulus both above and below the steam deflector.

2 Claims, 11 Drawing Figures

23
32
40
44
3
46
30
38
39
49
20
36
50
52
34

40
30
46

30
48
3
40

34
36
6
38
39
7
30

51
36
34
30
50
38
39
52
53

23
32
30
46
44
48
40
5
49
38
39
6
20
36
7
50
52
34

STEAM INJECTION SYSTEM FOR USE IN A WELL

CROSS REFERENCE TO RELATED APPLICATIONS

This application is related to U.S. application Ser. No. 714,941, filed Aug. 16, 1976, by S. O. Hutchison now abandoned and to U.S. application Ser. No. 783,135, filed Mar. 31, 1977 by S. O. Hutchison and G. W. Anderson.

FIELD OF THE INVENTION

The present invention relates to a steam injection system which includes a steam deflector connectable into a tubing string located in a well, and packer cups for packing off the tubing-well liner annulus both above and below the steam deflector. The steam deflector is adapted to selectively pass steam through the tubing string or to divert steam from the interior of the tubing string above the bottom thereof into the well liner-tubing annulus in a direction concentric with and substantially parallel to the longitudinal axis of the tubing string and the packer cups are adapted to pack off the well liner-tubing annulus both above and below the steam deflector.

BACKGROUND OF THE INVENTION

Steam injection is a standard technique for improving oil recovery from a well. It is often desirable to inject steam into a well at a location other than the bottom of the tubing. This is particularly true in thick formations. Initially, the practice was to simply direct the steam into a well liner-tubing annulus in the form of a jet at right angles to the tubing string. This, however, caused damage to the liner. Later steam deflectors were used to deflect the steam into the well liner-tubing annulus in a downward direction above the outside of the tubing. However, uniform and certain placement of the steam was not certain utilizing the prior art placement methods. The present invention provides a steam injection system which overcomes these problems.

BRIEF DESCRIPTION OF THE INVENTION

The present invention provides a steam injection system which includes a steam deflector connectable into a tubing string for selectively passing steam down the interior of the tubing string or for diverting the steam from the interior of the tubing string out into the well liner-tubing annulus in a direction concentric with and substantially parallel to the longitudinal axis of the tubing string and above the bottom thereof and at a velocity which does not substantially exceed the velocity of the steam formerly flowing inside of the deflector to prevent damage to the well liner and packer cup means packing off the tubing-liner annulus both above and below the steam deflector. A sliding sleeve and a ball are used to close off the interior of the steam deflector and to open a concentric annulus to steam flow to the outside of the steam deflector. The flow area of the concentric annulus is at least as great as the flow area through the interior of the deflector. A plurality of steam deflectors having different size of balls may be used to provide for a greater number of steam injection intervals.

PRINCIPAL OBJECT OF THE INVENTION

The principal objection of the present invention is to provide a steam injection system for directing steam either down the tubing string or out of the tubing string in a direction concentric with and substantially parallel to the longitudinal axis of the tubing string and at an acceptable velocity into a packed-off portion of the well liner-tubing annulus. Other objects and advantages of the invention will be apparent from the following specification and drawings which are incorporated herein and made a part of this specification.

DETAILED DESCRIPTION OF THE PREFERRED EMBODIMENT

Figure 1:
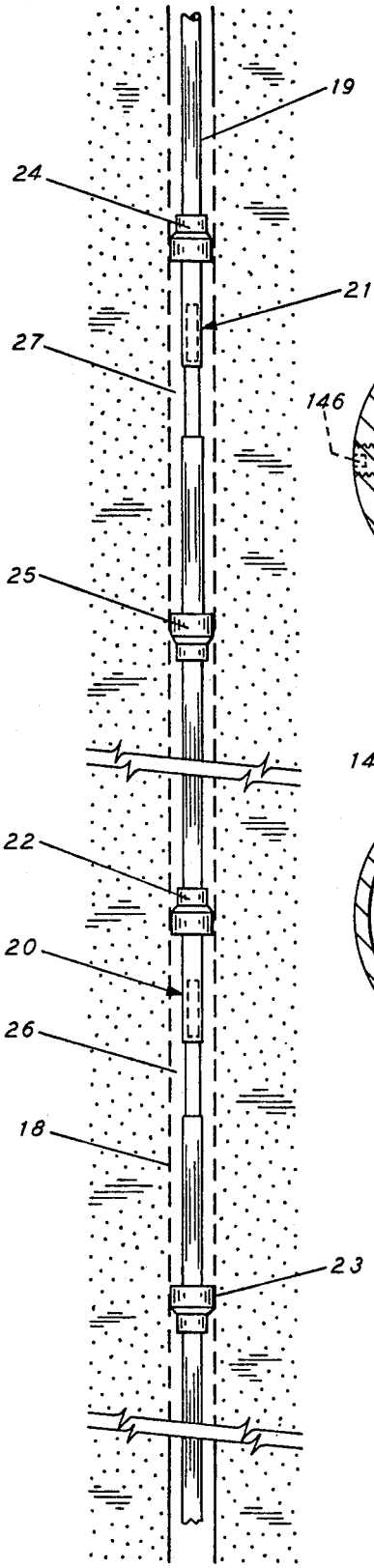
FIG. 1 is an elevation view partially in section and schematically illustrates apparatus assembled in accordance with the present invention positioned in a well adjacent a well liner.

FIG. 1 is an elevation view partially in section and illustrates steam deflector apparatus generally indicated by the numerals 20 and 21 connected on a tubing string 19 located in a well in accordance with the present invention. Steam is flowed into the tubing string from a steam generator (not shown) connected thereto. The steam deflector apparatus 20,21 are shown between sets of packer cup assemblies 22–23 and 24–25 respectively. The preferred form of packer cups useful in accordance with the present invention are described and claimed in copending application U.S. Ser. No. 714,941, filed Aug. 16, 1976. The disclosure of said application is hereby incorporated by reference herein.

The preferred packer cup such as indicated by the numeral 24 for example comprises a mandrel section connectable into a tubing string 19. A sealing element 17 is provided with a central opening in snug engagement over the mandrel section. The sealing element includes an annulary extending inner lip engaged against the mandrel section and an annularly extending outer lip engaged against the liner. A frangible annularly extending backup ring having an outer diamter of less than the outer diameter of the sealing element has a central opening slidably engageable over the mandrel section. Stop means are provided on the mandrel section abutting against the frangible backup ring to maintain the packer cup in a predetermined position on the mandrel section.

The steam deflectors are positioned adjacent a portion of the slots in well liner 25 in position to deflect steam into a selected portion of the liner-tubing annulus 26,27. The upper packer cup assemblies 22,24 are looking down to prevent fluids in the respective portion of the tubing 19-liner 18 annulus 27,26 from going up the well while the lower packer cup assemblies 23,25 are looking up to prevent fluids in the respective portion of the annulus 26,27 from going farther down the well. Thus, for example, in a steam injection operation where it is desired to inject steam into a particular interval, one set of the packer cup assemblies 22,23 are spaced apart on the tubing string 19 to bridge the interval and the steam is injected down the tubing string 19 and out the steam deflector 20 into annulus 26 and then forced out into the formation through the slots located in the liner 18 between the packer cup assemblies 24,25. When it is desired to inject steam into the upper annulus 27, the steam is diverted out of steam deflector 21 between packer cups 24,25.

Thus, the present invention is directed to a steam injection system comprising a steam deflector for initially directing steam flow down the interior of a tubing string into a well and later out of the steam deflector into the well liner-tubing string annulus in a direction concentric with and substantially parallel to the longitudinal axis of the tubing string. Means are provided for connecting the steam deflector into a tubing string and means are provided for selectively operating the steam deflector to divert steam flow out of the steam deflector into the well liner-tubing string annulus in a direction concentric with and substantially parallel to the longitudinal axis of the tubing string. Downward looking packer cup means are used to pack off the well liner-tubing string annulus above the steam deflector and upward looking packer cup means are used to pack off the well liner-tubing string annulus below the steam deflector. Steam generating means are connected to the tubing string for flowing steam into the tubing string.

Figures 2, 3, 4, 5, 6, 7:
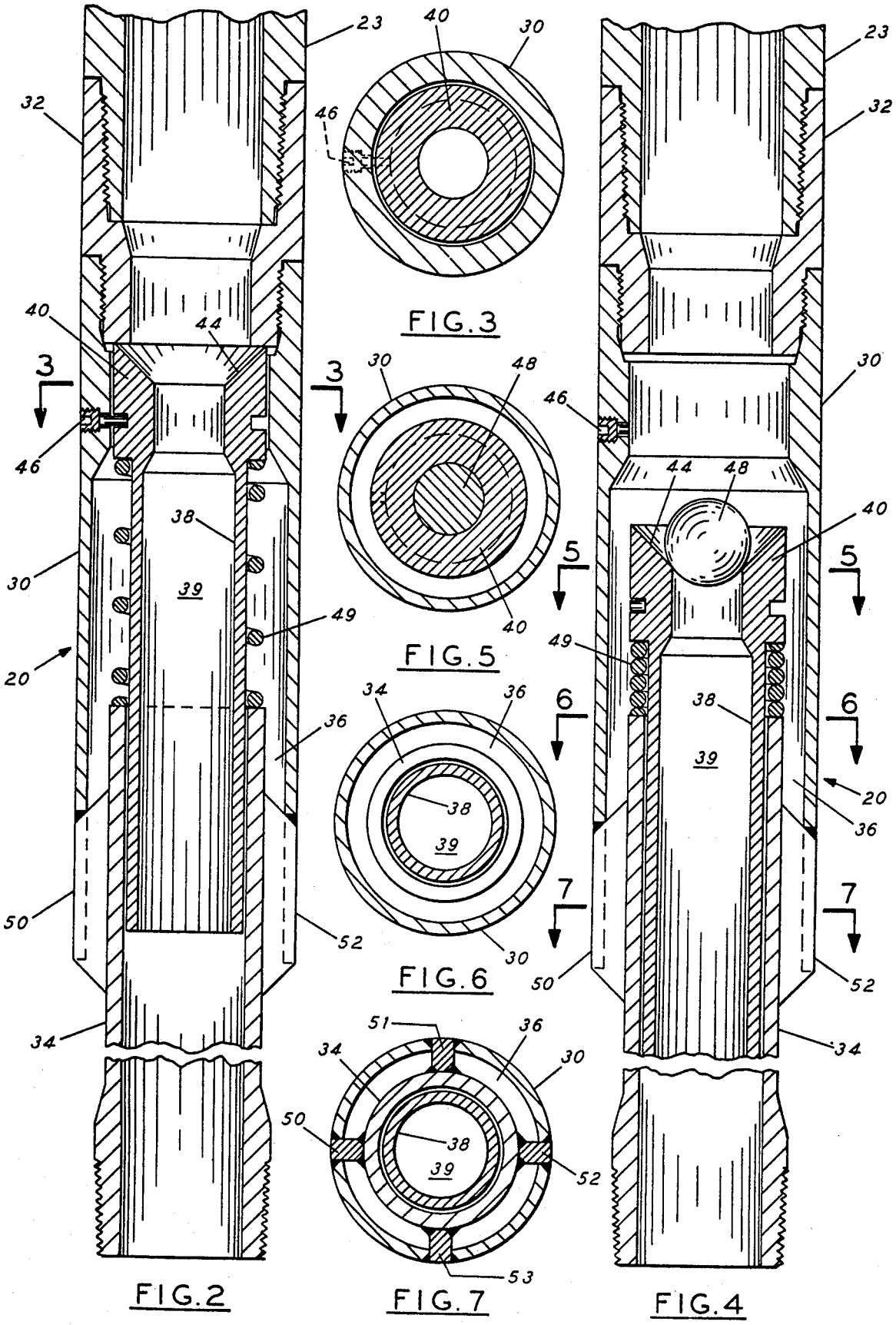
FIG. 2 is a sectional view illustrating the preferred steam deflector assembled in accordance with the present invention in a position to inject steam through the lower end of the tubing string.
FIG. 3 is a sectional view taken at line 3—3 of FIG. 2.
FIG. 4 is a sectional view of the preferred steam deflector assembled in accordance with the present invention in position to divert steam into the well liner-tubing annulus.
FIG. 5 is a sectional view taken at line 5—5 of FIG. 4.
FIG. 6 is a sectional view taken at line 6—6 of FIG. 4.
FIG. 7 is a sectional view taken at line 7—7 of FIG. 4.

FIGS. 2 and 4 are sectional views illustrating the a steam deflector indicated generally by the numeral 20 and useful in the present invention. FIGS. 3, 5, 6 and 7 are sectional taken as indicated from FIGS. 2 and 4 as there shown. The steam deflector is used to either permit steam flow down the tubing string or to divert steam flow from the interior of a tubing string into a well in a direction concentric with and substantially parallel to the longitudinal axis of the tubing string and at a velocity which does not substantially exceed the velocity of the steam that formerly flowed down the interior of the steam deflector. Thus, it may be first desirable to inject steam through the tubing string out the bottom thereof and to later divert the steam through the steam deflector into the well at a higher interval.

The steam deflector 20 includes an outer tubular skirt section 30. Means, such as adapter collar 32, are provided for connecting the upper end of skirt section 30 to the tubing string 19. The inner tubular section 34 of substantially smaller outer diameter than the inner diameter of the skirt section 30 is arranged with its upper portion extending coaxially interiorly of the lower portion of the skirt section 30 to form an annular chamber 36 between the skirt section 30 and the inner tubular section 34. This annular chamber 36 is substantially concentric with and parallel to the longitudinal axis of the tubing string 19. When steam is injected into the well through annular chamber 36 it enters the well in a direction substantially concentric with and parallel to the longitudinal axis of the tubing string. A sliding sleeve section 38 having a central opening 39 through its entire length has an elongated lower portion loosely and slidably engaged inside the inner tubular section for coaxial travel between an up position (FIG. 2) and a down position (FIG. 4) in the inner tubular section 34. The sliding sleeve section 38 includes an upper collar portion 40 which has an outer diameter substantially equal to the outer diameter of the inner tubular section 34. The collar portion 40 is loosely engagable in the up position against the inside of the outer tubular skirt section. It is preferred that about 0.010-inch clearance be maintained between the sliding sleeve section 38 and the skirt section 30 as well as the inner tubular section 34 so that about 2% of the injected steam will leak through this clearance when the deflector is in the FIG. 2 position to equalize the pressure in the tubing-liner annulus below and inside the packer cup assemblies.

A ball seat 44 is formed in the collar portion 40 of the sliding sleeve section adjacent the central opening thereof. A shear pin 46 is used to disconnectably connect the sliding sleeve section in the up position, thereby blocking off the annular chamber 36 to the major portion of flow from the inside of the tubular skirt section. A coil spring 49 also urges the sliding sleeve into the up position. A series of radially extending flanges 50,51,52,53 are positioned in the annular chamber and welded between the inner tubular section 34 and the skirt section 30 to connect them together. The flanges 50–53 are sized to maintain the cross-sectional flow area through the annular chamber 36 to at least a value equal to the cross-section flow area of the central opening 39 of the lower portion of the sliding sleeve section 38. Maintaining the cross-sectional area of the annular chamber 38 to a value at least equal to the cross-sectional area of the central opening 39 is an important feature of the present invention because it prevents critical flow from occurring through the annulus causing a vortex effect which picks up sand and damages the liner. A ball 48 or the like is sized for engagement in the ball seat 44 to close off flow through the central opening 39 in the sliding sleeve. Steam pressure then causes shear pin 46 to shear and disconnect the sliding sleeve section from the skirt section and depresses the sleeve section to the down position (FIG. 4) to open the annular chamber 36 to flow from the skirt section whereby steam is directed out of the annular chamber into the tubing-well liner annulus in a direction substantially concentric with and parallel to the longitudinal axis of the tubing string.

Figure 9:
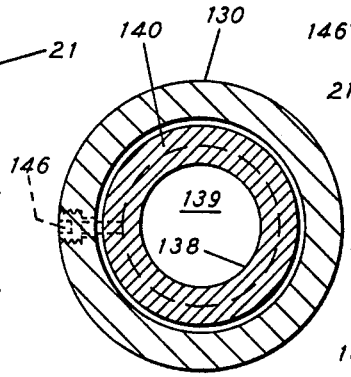
FIG. 9 is a sectional view taken at line 9—9 of FIG. 8.
Figure 8:
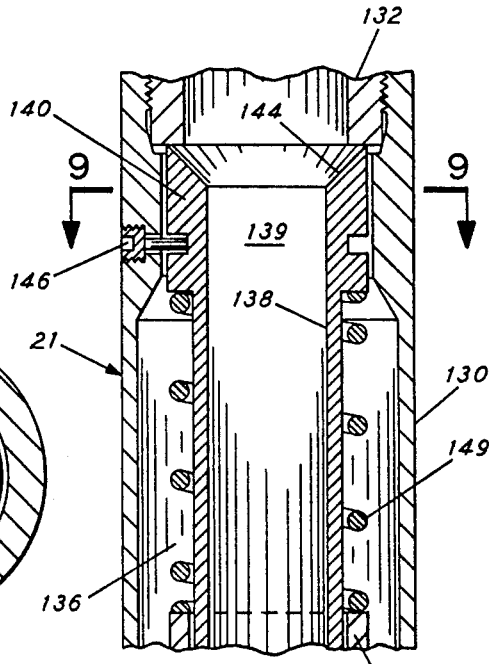
FIG. 8 is a sectional view illustrating an embodiment of apparatus assembled in accordance with the invention and useful in the tubing string above the FIG. 2–FIG. 7 embodiment to provide for a second level of steam injection, the apparatus being in position to direct steam down the tubing string.
Figure 11:
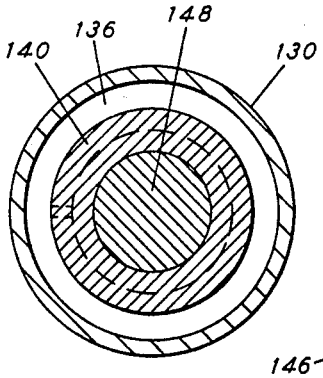
FIG. 11 is a sectional view taken at line 11—11 of FIG. 10.
Figure 10:
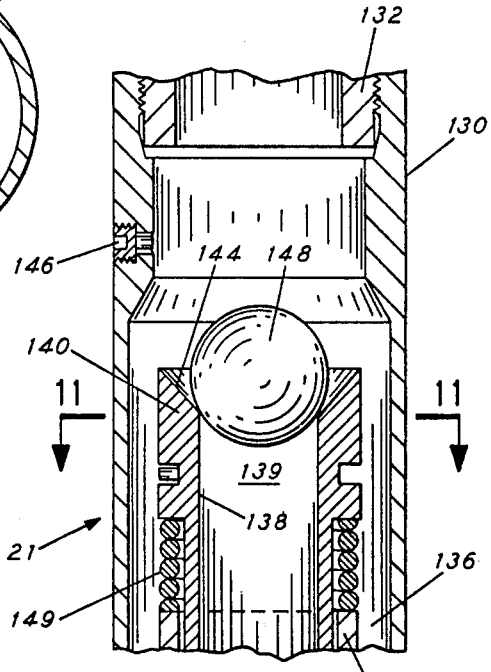
FIG. 10 is a sectional view of the FIG. 8 apparatus in position to divert steam into the well liner-tubing annulus.

FIGS. 8 and 10 are partial sectional views showing an upper steam deflector 21 useful with the present invention. FIGS. 9 and 11 are sectional views taken as indicated from FIGS. 8 and 10. Parts in the FIGS. 8 to 11 embodiment similar to corresponding parts in the FIGS. 1 to 7 embodiment are given numerals increased by 100 for ease of description. The principal difference of the FIGS. 8–11 embodiment is in the diameter of the ball seat 144 and ball 148 used to move the sliding sleeve 138 between an up and down position. The opening in the ball seat 144 is large enough to allow ball 48 to pass through to activate the lower steam deflector 10. A larger diameter ball 148 is required to active the upper steam deflector.

Thus, the upper steam deflector 21 includes an outer tubular skirt section 130. Means, such as adapter collar 132, are provided for connecting the upper end of skirt section 130 to the tubing string 19. An inner tubular section 134 of substantially smaller outer diameter than the inner diameter of the skirt section 30 is arranged with its upper portion extending coaxially interiorly of the lower portion of the skirt section 130 to form an annular chamber 136 between the skirt section 130 and the inner tubular section 134. This annular chamber 136 is substantially concentric with and parallel to the longitudinal axis of the tubing string 19. When steam is injected into the well through annular chamber 136 it enters the well in a direction substantially concentric with and parallel to the longitudinal axis of the tubing string. A sliding sleeve section 138 having a central opening 139 through its entire length has an elongated lower portion loosely and slidably engaged inside the inner tubular section for coaxial travel between an up position (FIG. 8) and a down position (FIG. 10) in the inner tubular section 134. The sliding sleeve section 138 includes an upper collar position 140 which has an outer diameter substantially equal to the outer diameter of the inner tubular section 134. The collar portion 140 is loosely engagable in the up position against the inside of the outer tubular skirt section. It is preferred that about 0.010-inch clearance be maintained between the sliding sleeve section 138 and the skirt section 130 as well as the inner tubular section 134 so that about 2% of the injected steam will leak through this clearance when the deflector is in the FIG. 8 position to equalize the pressure in the tubing-liner annulus below and inside the packer cup assemblies.

A ball seat 144 is formed in the collar portion 40 of the sliding sleeve section adjacent the central opening thereof. A shear pin 146 is used to disconnectably connect the sliding sleeve section in the up position, thereby blocking off the annular chamber 136 to the major portion of flow from the inside of the tubular skirt section. A coil spring 149 also urges the sliding sleeve into the up position. A series of radially extending flanges (not shown) are positioned in the annular chamber and welded between the inner tubular section 134 and the skirt section 130 to connect them together. The flanges are sized to maintain the cross-sectional flow area through the annular chamber 136 to at least a value equal to the cross-section flow area of the central opening 139 of the lower portion of the sliding sleeve section 138 to prevent undesirable vortexing of the steam. A ball 148 or the like is sized for engagement in the ball seat 144 to close off flow through the central opening 139 in the sliding sleeve. Steam pressure then causes shear pin 146 to shear and disconnect the sliding sleeve section from the skirt section and depresses the sleeve section to the down position (FIG. 10) to open the annular chamber 136 to flow from the skirt section whereby steam is directed out of the annular chamber into the the tubing-well liner annulus in a direction substantially concentric with and parallel to the longitudinal axis of the tubing string.

Although certain specific embodiments of the invention have been described in detail herein the invention is not to be limited to only those described embodiments but rather by the scope of the appended claims.

What is claimed is:

1. A steam injection system comprising a tubing string, a steam deflector connected into said tubing string operable for initially directing steam flow down the interior of said tubing string into a well and later out of the steam deflector into the well liner-tubing string annulus in a direction concentric with and substantially parallel to the longitudinal axis of the tubing string, means for operating said steam deflector to direct steam flow out of said steam deflector into the well liner-tubing string annulus in a direction concentric with and substantially parallel to the longitudinal axis of the tubing string, downward looking packer cup means packing off the well liner-tubing string annulus above said steam deflector, upward looking packer cup means packing off said well liner-tubing string annulus below said steam deflector and steam generating means connected to said tubing string for flowing steam into said tubing string.

2. The apparatus of claim 1 further characterized by a second steam deflector connected into said tubing string, second downward looking and upward looking packer cup means packing off the well liner-tubing annulus above and below said second steam deflector and second means for operating said second steam deflector.

* * * * *